US010612498B2

(12) United States Patent
Ishihara et al.

(10) Patent No.: US 10,612,498 B2
(45) Date of Patent: Apr. 7, 2020

(54) INTAKE MANIFOLD OF VERTICAL MULTICYLINDER ENGINE

(71) Applicant: KUBOTA Corporation, Osaka-shi, Osaka (JP)

(72) Inventors: Mutsuhisa Ishihara, Sakai (JP); Yasushi Nakamura, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 538 days.

(21) Appl. No.: 14/842,314

(22) Filed: Sep. 1, 2015

(65) Prior Publication Data

US 2016/0090949 A1 Mar. 31, 2016

(30) Foreign Application Priority Data

Sep. 30, 2014 (JP) ..... 2014-200795

(51) Int. Cl.
*F02M 35/10* (2006.01)
*F02M 35/104* (2006.01)
(Continued)

(52) U.S. Cl.
CPC .. *F02M 35/10222* (2013.01); *F02M 25/0722* (2013.01); *F02M 26/19* (2016.02);
(Continued)

(58) Field of Classification Search
USPC ..... 123/568.17
See application file for complete search history.

(56) References Cited

U.S. PATENT DOCUMENTS

2007/0271920 A1 11/2007 Marsal et al.
2011/0061630 A1* 3/2011 Yoshii ..... F02M 35/10111 123/456
2012/0180478 A1* 7/2012 Johnson ..... F02D 9/02 60/605.2

FOREIGN PATENT DOCUMENTS

DE 9316647 U1 1/1994
DE G 93 16 647.8 U1 * 3/1994
(Continued)

OTHER PUBLICATIONS

Extended Search Report dated Mar. 18, 2016 in EP Application No. 15178608.4.
(Continued)

*Primary Examiner* — Phutthiwat Wongwian
*Assistant Examiner* — Omar Morales
(74) *Attorney, Agent, or Firm* — Panich Schwarze Belisario & Nadel LLP

(57) ABSTRACT

There is provided an intake manifold of a multicylinder engine capable of facilitating homogenization of concentration distribution of EGR gas in intake air and distribution of EGR gas into respective cylinders. The intake manifold is configured such that an EGR gas guide portion is provided in an intake air introducing sleeve portion, the EGR gas guide portion includes an upstream EGR gas release port and a downstream EGR gas release port, the upstream EGR gas release port is provided on a side of a passage outlet of an EGR gas introducing passage, the downstream EGR gas release port is provided on an opposite side of a central portion of the intake air introducing sleeve portion from the upstream EGR gas release port, and the EGR gas introduced from the passage outlet of the EGR gas introducing passage into the intake air introducing sleeve portion is released from both of the upstream EGR gas release port and the down-
(Continued)

stream EGR gas release port into intake air passing through the central portion of the intake air introducing sleeve portion.

11 Claims, 3 Drawing Sheets

(51) Int. Cl.

| | |
|---|---|
| ***F02M 25/07*** | (2006.01) |
| ***F02M 26/41*** | (2016.01) |
| ***F02M 26/42*** | (2016.01) |
| ***F02M 26/19*** | (2016.01) |
| *F02M 35/112* | (2006.01) |

(52) U.S. Cl.
CPC ..... *F02M 26/41* (2016.02); *F02M 26/42* (2016.02); *F02M 35/104* (2013.01); *F02M 35/1045* (2013.01); *F02M 35/112* (2013.01)

(56) References Cited

FOREIGN PATENT DOCUMENTS

| | | | | | |
|---|---|---|---|---|---|
| DE | 10118490 | A1 | | 10/2001 | |
| DE | 102007035556 | A1 | * | 1/2009 | ..... B01F 3/02 |
| EP | 1580421 | A1 | | 9/2005 | |
| JP | H1077913 | A | | 3/1998 | |
| JP | 10196466 | A | * | 7/1998 | |
| JP | H10196466 | A | | 7/1998 | |
| JP | 2007205264 | A | | 8/2007 | |
| JP | 2011064163 | A | | 3/2011 | |

OTHER PUBLICATIONS

Examination Report dated Mar. 6, 2017 in EP Application No. 15 178 608.4.
Office Action dated Sep. 13, 2017 in JP Application No. 2014200795.

* cited by examiner

FRONT
BACK vertical direction
front-back direction
lateral direction
FRONT
BACK

INTAKE MANIFOLD OF VERTICAL MULTICYLINDER ENGINE

BACKGROUND OF THE INVENTION (1) Field of the Invention

The present invention relates to an intake manifold of a multicylinder engine.

(2) Description of Related Art

Conventionally, as an intake manifold of a multicylinder engine, there is an intake manifold in which an entire Exhaust Gas Recovery gas (hereafter referred to as "EGR gas") introduced into an intake air introducing sleeve portion is released from a side of a passage outlet of a gas introducing passage into an intake air passing through the intake air introducing sleeve portion.

In the conventional intake manifold, the EGR gas is likely to be diffused into part of the intake air passing through the intake air introducing sleeve portion and close to the passage outlet while the EGR gas is less likely to be diffused into part of the intake air far from the passage outlet, and concentration distribution of the EGR gas in the intake air is likely to become inhomogeneous. Moreover, the EGR gas is likely to be distributed into the cylinders on the side of the intake air introducing sleeve portion close to the EGR gas introducing passage while the EGR gas is less likely to be distributed into the cylinders on a side of the intake air introducing sleeve portion far from the EGR gas introducing passage due to the fact that the intake air passing through the intake air introducing sleeve portion functions as an air curtain. For this reason, distribution of the EGR gas into the respective cylinders is likely to become inhomogeneous.

For this reason, a function of reducing $NO_x$ and output performance are likely to become insufficient.

SUMMARY OF THE INVENTION

An object of the present invention is to provide an intake manifold of a multicylinder engine capable of facilitating homogenization of concentration distribution of EGR gas in intake air and distribution of EGR gas into respective cylinders.

Matters specifying the present invention are as follows.

An intake manifold of a multicylinder engine including: a manifold main body; an intake air introducing sleeve portion; and an EGR gas introducing passage, and configured such that when a longitudinal direction of the manifold main body is defined as a front-back direction, a passage outlet of the EGR gas introducing passage is provided on a front side or a back side of a sleeve portion peripheral wall of the intake air introducing sleeve portion and EGR gas is introduced from the passage outlet of the EGR gas introducing passage into the intake air introducing sleeve portion, wherein the intake manifold is configured such that an EGR gas guide portion is provided in the intake air introducing sleeve portion, the EGR gas guide portion includes an upstream EGR gas release port and a downstream EGR gas release port, the upstream EGR gas release port is provided on a side of the passage outlet of the EGR gas introducing passage, the downstream EGR gas release port is provided on an opposite side of a central portion of the intake air introducing sleeve portion from the upstream EGR gas release port, and the EGR gas introduced from the passage outlet of the EGR gas introducing passage into the intake air introducing sleeve portion is released from both of the upstream EGR gas release port and the downstream EGR gas release port into intake air passing through the central portion of the intake air introducing sleeve portion.

The invention according to the present invention exerts the following effect.

The EGR gas is likely to be diffused into front and back parts of the intake air passing through the central portion of the intake air introducing sleeve portion and the concentration distribution of the EGR gas in the intake air is likely to become homogeneous. Moreover, the EGR gas is likely to be distributed into the respective cylinders on the front and back sides of the intake air introducing sleeve portion, and homogenization of distribution of the EGR gas into the respective cylinders is facilitated.

BRIEF DESCRIPTION OF THE DRAWINGS

FIGS. 1A to 1E are diagrams for explaining an intake manifold of an engine according to an embodiment of the present invention, wherein FIG. 1A is a plan view of a state in which the intake manifold is mounted to a cylinder head, FIG. 1B is a sectional view taken along line B-B in FIG. 1A, FIG. 1C is a sectional view taken along line C-C in FIG. 1A, FIG. 1D is a sectional view taken along line D-D in FIG. 1C, and FIG. 1E is a sectional view taken along line E-E in FIG. 1C;

FIGS. 2A to 2E are diagrams for explaining the intake manifold in FIGS. 1A to 1E, wherein FIG. 2A is a side view, FIG. 2B is a view taken in a direction of arrow B in FIG. 2A, FIG. 2C is a sectional view taken along line C-C in FIG. 2A; FIG. 2D is a sectional view taken along line D-D in FIG. 2A, and FIG. 2E is a sectional view taken along line E-E in FIG. 2A.

DETAILED DESCRIPTION OF PREFERRED EMBODIMENT

FIGS. 1A to 3 are diagrams for explaining of an intake manifold of a multicylinder engine according to an embodiment of the present invention. In the embodiment, an intake manifold of a vertical four-cylinder diesel engine will be described.

A general outline of the intake manifold is as follows.

Figures 1A, 1B, 1C, 1D, 1E:
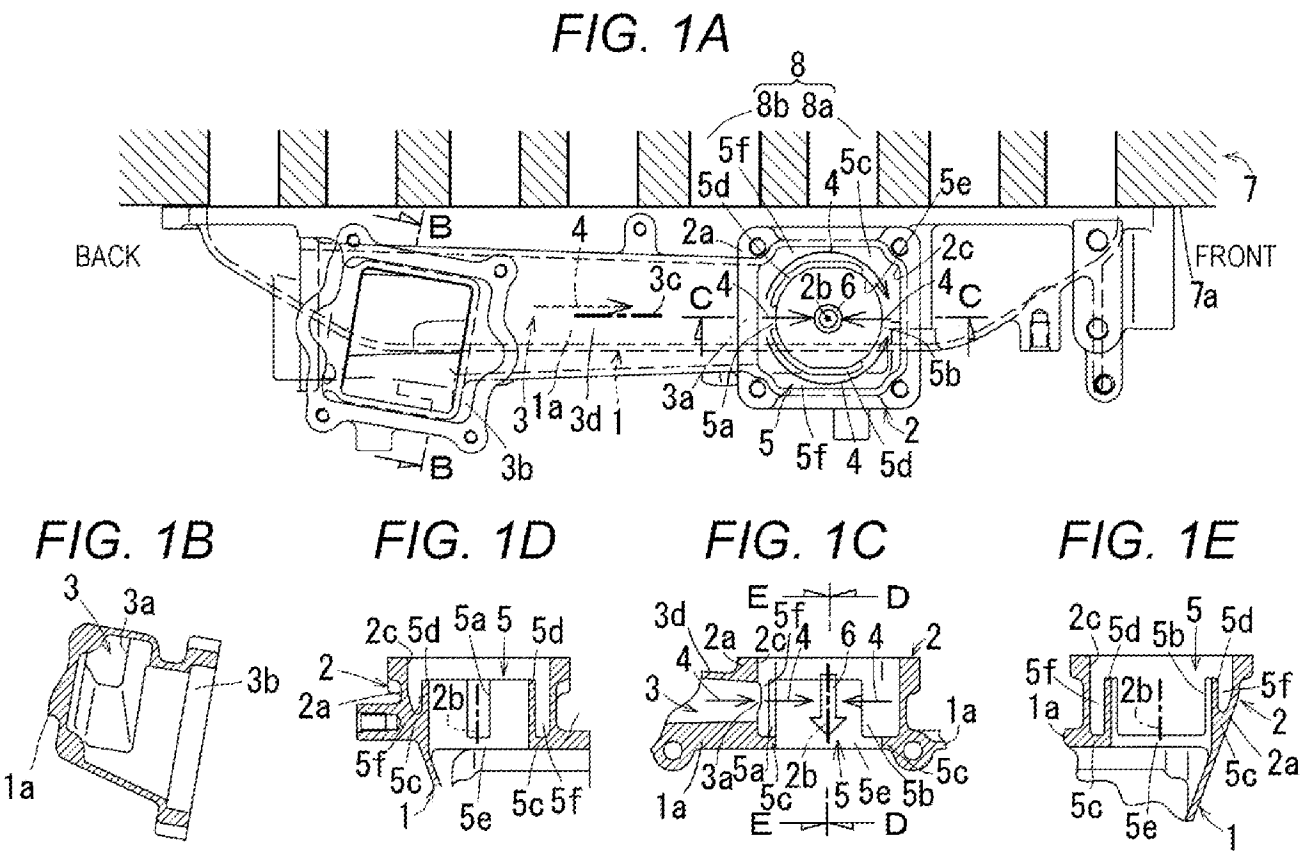

As shown in FIGS. 1A and 1C, the intake manifold includes a manifold main body (1), an intake air introducing sleeve portion (2), and an EGR gas introducing passage (3) having an EGR gas introducing passage central axis (3*c*). The intake manifold is configured such that when a longitudinal direction of the manifold main body (1) is defined as a front-back direction, a passage outlet (3*a*) of the EGR gas introducing passage (3) is provided on a back side of a sleeve portion peripheral wall (2*a*) of the intake air introducing sleeve portion (2) and EGR gas (4) is introduced from the passage outlet (3*a*) of the EGR gas introducing passage (3) into the intake air introducing sleeve portion (2).

The passage outlet (3*a*) of the EGR gas introducing passage (3) may be provided on a front side of the sleeve portion peripheral wall (2*a*) of the intake air introducing sleeve portion (2).

Figures 2A, 2B, 2C, 2D, 2E:
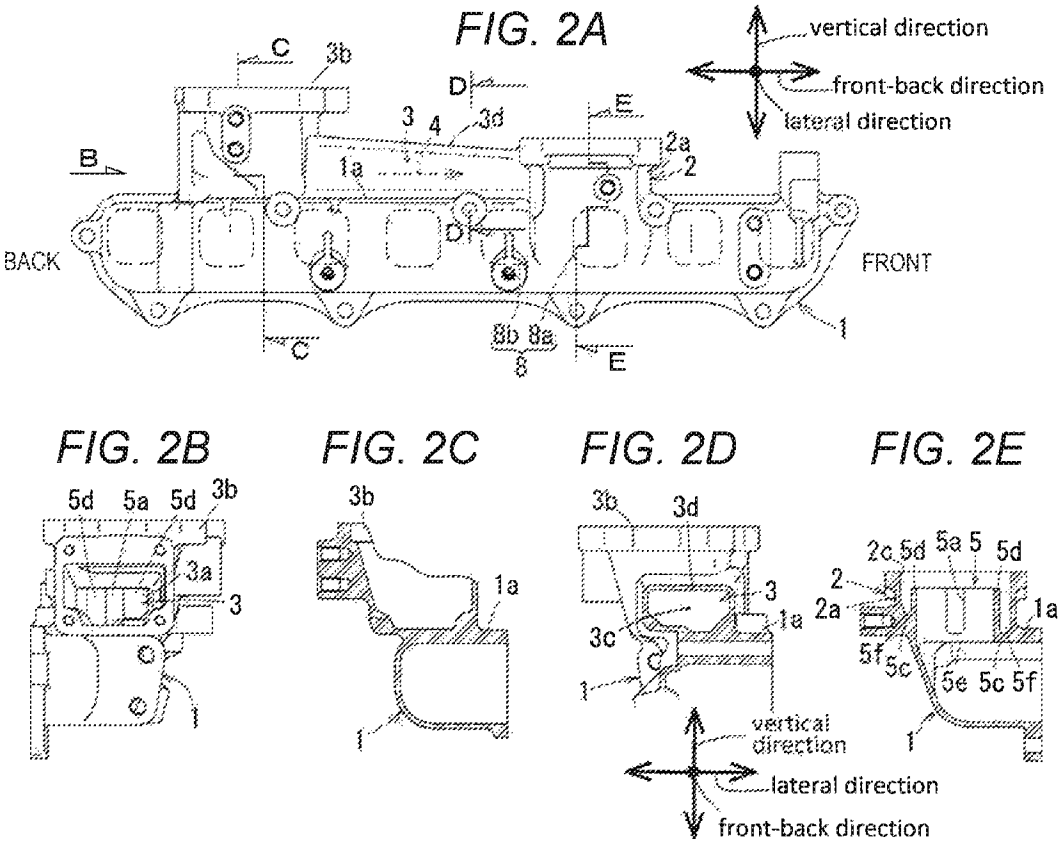
Figure 3:
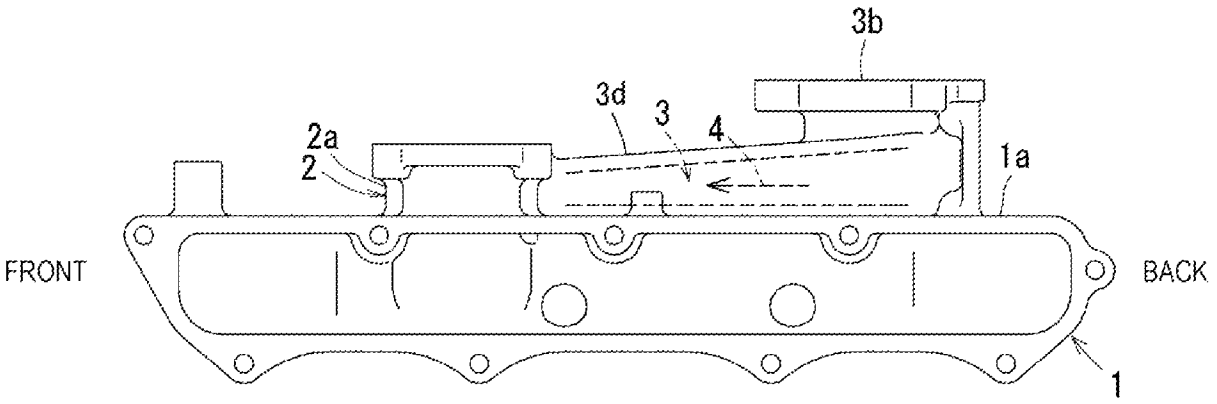
FIG. 3 is a side view of the intake manifold in FIGS. 1A to 1E seen from a side of the cylinder head.

As shown in FIGS. 1A, 2A, and 3, the manifold main body (1) has a box-shaped structure without a branch portion and an entire face of the manifold main body (1) on a side of a cylinder head (7) opens.

As shown in FIG. 1A, the intake air introducing sleeve portion (2) includes a square sleeve body casted integrally with the manifold main body (1).

As shown in FIGS. 1A and 2A, the intake air introducing sleeve portion (2) is provided relatively close to a front side of the manifold main body (1) and disposed at an opening position of an intake port (8) of a second cylinder in the cylinder head (7). The intake port (8) of the cylinder head (7) includes a pair of front and back ports (8*a*) and (8*b*). The front port (8*a*) is a swirl port, and the back port (8*b*) is a tangential port. Intake ports of other cylinders have similar structures and openings of the respective intake ports (8) of a first cylinder, the second cylinder, a third cylinder, and a fourth cylinder are disposed in a lateral wall (7*a*) of the cylinder head (7) in this order from the front side in a line.

As shown in FIGS. 1A and 1B, the EGR gas introducing passage (3) is provided behind the intake air introducing sleeve portion (2). A passage inlet (3*b*) of a back end portion of the EGR gas introducing passage (3) is in a hopper shape which opens on an upper side. An EGR valve (not shown) is attached to an upper portion of the passage inlet (3*b*), and a check valve (not shown) is housed inside of the passage inlet (3*b*). As shown in FIGS. 1A, 2A, and 3, a passage sectional area of the EGR gas introducing passage (3) gradually reduces toward the intake air introducing sleeve portion (2). Note that an opening at the back end of the EGR gas introducing passage (3) shown in FIG. 2B is closed with a lid body.

A structure in the intake air introducing sleeve portion (2) is as follows.

As shown in FIGS. 1A and 1C, an EGR gas guide portion (5) is provided in the intake air introducing sleeve portion (2). The EGR gas guide portion (5) includes an upstream EGR gas release port (5*a*) and a downstream EGR gas release port (5*b*). The upstream EGR gas release port (5*a*) is provided on a side of the passage outlet (3*a*) of the EGR gas introducing passage (3), and the downstream EGR gas release port (5*b*) is provided on an opposite side of a central portion of the intake air introducing sleeve portion (2) from the upstream EGR gas release port (5*a*).

As shown in FIGS. 1A and 1C, the intake manifold is configured such that the EGR gas (4) introduced from the passage outlet (3*a*) of the EGR gas introducing passage (3) into the intake air introducing sleeve portion (2) is released from both of the upstream EGR gas release port (5*a*) and the downstream EGR gas release port (5*b*) into intake air (6) passing through the central portion of the intake air introducing sleeve portion (2). For this reason, the EGR gas (4) is likely to be diffused into front and back parts of the intake air (6) passing through the central portion of the intake air introducing sleeve portion (2) and the concentration distribution of the EGR gas (4) in the intake air (6) is likely to become homogeneous. Moreover, the EGR gas (4) is likely to be distributed into the respective cylinders on the front and back sides of the intake air introducing sleeve portion (2), and homogenization of distribution of the EGR gas (4) into the respective cylinders is facilitated.

A specific structure of the EGR gas guide portion (5) is as follows.

As shown in FIGS. 1A, 1C, 1D and 1E, the EGR gas guide portion (5) includes a guide bottom wall (5*c*) and a guide peripheral wall (5*d*). The guide bottom wall (5*c*) bulges into the intake air introducing sleeve portion (2) in a direction intersecting a central axis (2*b*) of the intake air introducing sleeve portion (2). The guide peripheral wall (5*d*) is led out from an opening edge portion of an intake air passing port (5*e*) surrounded with the guide bottom wall (5*c*) toward an inlet (2*c*) of the intake air introducing sleeve portion (2). The upstream EGR gas release port (5*a*) and the downstream EGR gas release port (5*b*) open on the guide peripheral wall (5*d*), and an EGR gas guide clearance (5*f*) sandwiched between the sleeve portion peripheral wall (2*a*) of the intake air introducing sleeve portion (2) and the guide peripheral wall (5*d*) is formed between the passage outlet (3*a*) of the EGR gas introducing passage (3) and the downstream EGR gas release port (5*b*). In this situation, the EGR gas guide portion (5) is housed in the intake air introducing sleeve portion (2) and does not require complicated piping. For this reason, it is possible to make the intake manifold compact.

As shown in FIG. 1A, the intake air passing port (5*e*) is in a circular shape. The guide peripheral wall (5*d*) led out from the opening edge portion of the intake air passing port (5*e*) toward the inlet (2*c*) of the intake air introducing sleeve portion (2) is in a circular cylindrical shape, but the upstream EGR gas release port (5*a*) opens in a slit shape in a front portion of the guide peripheral wall (5*d*), and the downstream EGR gas release port (5*b*) opens in a slit shape in a back portion of the guide peripheral wall (5*d*). For this reason, the EGR gas (4) overflowing the EGR gas guide clearance (5*f*) is likely to be diffused into opposite side parts of the intake air (6) passing through the intake air introducing sleeve portion (2) and the concentration distribution of the EGR gas (4) in the intake air (6) is likely to become homogeneous.

As shown in FIGS. 1A, 1D, and 1E, an end portion of the EGR gas guide clearance (5*f*) on a side of the inlet (2*c*) of the intake air introducing sleeve portion (2) opens in the intake air introducing sleeve portion (2).

As shown in FIGS. 1D and 1E, the upstream EGR gas release port (5*a*) opens with a smaller opening area than the downstream EGR gas release port (5*b*). For this reason, the EGR gas (4) released from the upstream EGR gas release port (5*a*) receives throttle resistance, and the throttle resistance balances with passage resistance of the EGR gas guide clearance (5*f*), which the EGR gas (4) released from the downstream EGR gas release port (5*b*) receives. For this reason, amounts of the EGR gas (4) released from the upstream EGR gas release port (5*a*) and the EGR gas (4) released from the downstream EGR gas release port (5*b*) are likely to be equalized and the concentration distribution of the EGR gas (4) in the intake air (6) is likely to become homogeneous.

As shown in FIGS. 1A, 2A, and 3, the intake air introducing sleeve portion (2) and the EGR gas introducing passage (3) are provided in a ceiling wall (1*a*) of the manifold main body (1) and the intake air introducing sleeve portion (2) is led out upward from the ceiling wall (1*a*) of the manifold main body (1). For this reason, the intake air introducing sleeve portion (2) and the EGR gas introducing passage (3) do not bulge sideways from the manifold main body (1), and it is possible to reduce the width of the engine.

What is claimed is:

1. An intake manifold of a vertical multicylinder engine comprising:

a manifold main body; an intake air introducing sleeve portion; and an EGR gas introducing passage, and configured such that when a longitudinal direction of the manifold main body is defined as a front-back direction, a passage outlet of the EGR gas introducing passage is provided on a front side or a back side of a sleeve portion peripheral wall of the intake air introducing sleeve portion and EGR gas is introduced from the passage outlet of the EGR gas introducing passage into the intake air introducing sleeve portion, wherein the intake manifold is configured such that an EGR gas guide portion is provided in the intake air introducing sleeve portion, the EGR gas guide portion includes an upstream EGR gas release port and a downstream EGR gas release port, the upstream EGR gas release port is provided on a side of the passage outlet of the EGR gas introducing passage, the downstream EGR gas release port is provided on an opposite side of a central portion of the intake air introducing sleeve portion from the upstream EGR gas release port, the EGR gas introduced from the passage outlet of the EGR gas introducing passage into the intake air introducing sleeve portion is released from both of the upstream EGR gas release port and the downstream EGR gas release port into intake air passing through the central portion of the intake air introducing sleeve portion;

the manifold main body has a box-shaped configuration having no branch portion and extending along a lateral side surface of a cylinder head, the manifold main body having an entire surface facing the cylinder head defining a lateral opening and a ceiling wall out of four walls that surround the lateral opening from top, bottom, front and back, the ceiling wall being long in the front-back direction and being located closest to the EGR gas introducing passage;

wherein the intake air introducing sleeve portion and the EGR gas introducing passage are provided in the ceiling wall of the manifold main body and the intake air introducing sleeve portion is led out from the ceiling wall of the manifold main body;

wherein, when viewed in a direction extending along both the lateral side surface of the cylinder head and a central axis of the intake air introducing sleeve portion, both the central axis of the intake air introducing sleeve portion and a central axis of the EGR gas introducing passage are in a place where the central axis of the intake air introducing sleeve portion and the central axis of the EGR gas introducing passage overlap the manifold main body having the box-shaped configuration and extending along the lateral side surface of the cylinder head; and wherein the EGR gas introducing passage is formed integrally with the ceiling wall provided on an upper side of the manifold main body, and, when a direction perpendicular to the front-back direction and a vertical direction is defined as a lateral direction, a cross-section of the EGR gas introducing passage is formed in a horizontally long shape along the ceiling wall provided on the upper side of the manifold main body, when viewed from a visual line in the front-back direction extending along the central axis of the EGR gas introducing passage.

2. The intake manifold of a vertical multicylinder engine according to claim 1, wherein the EGR gas guide portion includes a guide bottom wall and a guide peripheral wall, the guide bottom wall bulges into the intake air introducing sleeve portion in a direction intersecting a central axis of the intake air introducing sleeve portion, the guide peripheral wall is led out from an opening edge portion of an intake air passing port surrounded with the guide bottom wall toward an inlet of the intake air introducing sleeve portion, the upstream EGR gas release port and the downstream EGR gas release port open on the guide peripheral wall, and an EGR gas guide clearance sandwiched between the sleeve portion peripheral wall of the intake air introducing sleeve portion and the guide peripheral wall is formed between the passage outlet of the EGR gas introducing passage and the downstream EGR gas release port.

3. The intake manifold of a vertical multicylinder engine according to claim 2, wherein an end portion of the EGR gas guide clearance on a side of the inlet of the intake air introducing sleeve portion opens in the intake air introducing sleeve portion.

4. The intake manifold of a vertical multicylinder engine according to claim 3, wherein the upstream EGR gas release port opens with a smaller opening area than the downstream EGR gas release port.

5. The intake manifold of a vertical multicylinder engine according to claim 3, wherein the EGR gas guide portion includes a single upstream EGR gas release port and a single downstream EGR gas release port.

6. The intake manifold of a vertical multicylinder engine according to claim 3, wherein a wall out of walls that surround the EGR gas introducing passage from top, bottom, right and left, the wall being furthest apart from the ceiling wall of the manifold main body when viewed in a direction extending along the central axis of the EGR gas introducing passage, is a passage ceiling wall of the EGR gas introducing passage, and the passage ceiling wall provided on an upper side of the EGR gas introducing passage is inclined as gradually approaching toward the ceiling wall provided on the upper side of the manifold main body, from a starting end side of the EGR gas introducing passage to the EGR gas guide clearance.

7. The intake manifold of a vertical multicylinder engine according to claim 6, wherein the upstream EGR gas release port opens with a smaller opening area than the downstream EGR gas release port.

8. The intake manifold of a vertical multicylinder engine according to claim 2, wherein the upstream EGR gas release port opens with a smaller opening area than the downstream EGR gas release port.

9. The intake manifold of a vertical multicylinder engine according to claim 2, wherein the EGR gas guide portion includes a single upstream EGR gas release port and a single downstream EGR gas release port.

10. The intake manifold of a vertical multicylinder engine according to claim 1, wherein the upstream EGR gas release port opens with a smaller opening area than the downstream EGR gas release port.

11. The intake manifold of a vertical multicylinder engine according to claim 1, wherein the EGR gas guide portion includes a single upstream EGR gas release port and a single downstream EGR gas release port.

* * * * *